US009124076B2

(12) United States Patent
Benz et al.

(10) Patent No.: US 9,124,076 B2
(45) Date of Patent: Sep. 1, 2015

(54) SPARK PLUG

(75) Inventors: Andreas Benz, Bamberg (DE); Jochen Fischer, Bamberg (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 14/235,167

(22) PCT Filed: Jun. 1, 2012

(86) PCT No.: PCT/EP2012/060365
§ 371 (c)(1),
(2), (4) Date: Apr. 22, 2014

(87) PCT Pub. No.: WO2013/017310
PCT Pub. Date: Feb. 7, 2013

(65) Prior Publication Data

US 2014/0246972 A1 Sep. 4, 2014

(30) Foreign Application Priority Data

Aug. 3, 2011 (DE) ..... 10 2011 080 356

(51) Int. Cl.
*H01T 13/32* (2006.01)
*H01T 13/46* (2006.01)
*H01T 13/20* (2006.01)

(52) U.S. Cl.
CPC ..... *H01T 13/32* (2013.01); *H01T 13/467* (2013.01); *H01T 13/20* (2013.01)

(58) Field of Classification Search
CPC ..... H01T 13/20; H01T 13/32
USPC ..... 313/140–141
See application file for complete search history.

(56) References Cited

U.S. PATENT DOCUMENTS

| | | | |
|---|---|---|---|
| 5,610,470 | A | 3/1997 | Wofsey |
| 2004/0041505 | A1 | 3/2004 | Fischer et al. |
| 2005/0174025 | A1 | 8/2005 | Okamoto |
| 2010/0244651 | A1 | 9/2010 | Freeman et al. |

FOREIGN PATENT DOCUMENTS

| | | |
|---|---|---|
| CN | 201421949 | 3/2010 |
| DE | 101 55 404 | 5/2003 |
| EP | 01 34 355 | 3/1985 |
| EP | 1 311 041 | 5/2003 |

*Primary Examiner* — Mary Ellen Bowman
(74) *Attorney, Agent, or Firm* — Kenyon & Kenyon LLP

(57) ABSTRACT

A spark plug including a housing as a ground contact to an internal combustion engine, a center electrode situated in the housing along a center axis of the spark plug, an insulator between the center electrode and the housing, and a two-legged ground electrode whose legs are located on the combustion chamber side of the center electrode and angled with respect to one another in a leg plane which is perpendicular to the center axis, the two ends of the ground electrode being connected to the housing respectively by one connection point, a first gap between one end of the housing on the combustion chamber side and the leg plane being smaller than or equal to a second gap between one of the connection points and the center axis, and/or the ground electrode being tapered toward the center axis.

26 Claims, 4 Drawing Sheets

SPARK PLUG

FIELD OF THE INVENTION

The present invention relates to a spark plug for internal combustion engines.

BACKGROUND INFORMATION

The publication US 2010/0244651 A1 discusses a previously known spark plug, in which the ground electrode is welded on both sides to the front side of the housing in the form of a bridge. Because of the two opposite weld points, this ground electrode is subjected to high thermal stresses, which are in particular caused by the different thermal expansion coefficients of the electrode material and the housing material. In addition, with the bridge-shaped ground electrode, it is not possible to subsequently adjust the gap between the center electrode and the ground electrode by bending the ground electrode.

Publication DE 101 55 404 A1 discusses a spark plug according to the definition of the general species of spark plug. Here, the housing having the thread is very deeply recessed with respect to the combustion chamber end of the center electrode. Consequently, the ground electrode includes a very long component extending parallel to the center axis of the spark plug. This configuration has two decisive disadvantages: The relatively large and long ground electrode constitutes a relatively large surface for absorbing the heat in the combustion chamber. Relative to this very large heat-absorbing surface, the previously known ground electrode has only a very small cross section at the connection point between the ground electrode and the housing. Only this very small cross-sectional area may be used for dissipating heat from the ground electrode into the housing. This unfavorable relationship between the heat-absorbing surface and the heat-dissipating cross section causes substantial thermal stress of this previously known ground electrode, thus resulting in increased oxidation and a shorter lifetime. In addition, this configuration has substantial disadvantages when adjusting the gap between the center electrode and the ground electrode. To adjust this gap, the ground electrode must be bent toward the center electrode after connection to the housing. The previously known ground electrode has a very long component parallel to the center axis of the spark plug. When bending the portion of the ground electrode opposite the center electrode, an unfavorable bending moment acts on the portion of the ground electrode parallel to the center axis. Adjustment of the gap is thus not optimally possible in the previously known arrangement.

SUMMARY OF THE INVENTION

The present invention having the features described herein describes a spark plug having a ground electrode which absorbs as little heat as possible via its surface and thus has lower oxidation and an extended lifetime. In addition, the spark plug according to the present invention has a short length, high rigidity, and the possibility of simple adjustment of the electrode gap between the center and ground electrodes. The spark plugs according to the present invention are proposed for use in stationary gas engines having prechambers, which have high combustion chamber pressures and temperatures. However, in addition, any other use, for example, in motor vehicles, is reasonable. The advantages are achieved with the aid of a spark plug including a housing as the ground contact to an internal combustion engine, which includes a center electrode situated in the housing along a center axis of the spark plug, an insulator between the center electrode and the housing, and a two-legged ground electrode, whose legs are located on the combustion chamber side of the center electrode and angled with respect to one another in a leg plane which is perpendicular to the center axis, the two ends of the ground electrode being connected to the housing respectively at one connection point, a first gap between one end of the housing on the combustion chamber side and the leg plane being smaller than or equal to a second gap between one of the connection points and the center axis, and/or the ground electrode being tapered toward the center axis. The circumference of the ground electrode is relevant for the surface of the ground electrode.

Consequently, it is also defined that the circumference of the ground electrode tapers toward the center axis. The connection points between the ground electrode and the housing may be formed as weld connections. The leg plane is located opposite the center electrode or the end of the center electrode on the combustion chamber side. The spark generation of the spark plug according to the present invention occurs between the ground electrode in the leg plane and the center electrode. The object forming the basis of the present invention, namely, minimizing the heat transfer from the combustion chamber to the ground electrode, is achieved according to the present invention based on two different approaches.

According to the first approach, the gap from the end of the housing on the combustion chamber side to the leg plane is kept as small as possible. The overall surface of the ground electrode is thus reduced and the heat transfer of the ground electrode is consequently minimized. In the second approach, it is taken into account that the ground electrode in the leg plane is subjected to the highest temperature in the combustion chamber. The ground electrode is consequently tapered toward the center axis. Both approaches thus have in common that they describe a surface of the ground electrode which is as small as possible. However, at the same time, the ground electrode is two-legged in both approaches. The two legs are angled with respect to one another so that the two connection points between the ground electrode and the housing do not face each other.

Consequently, it is possible to adjust the gap between the center electrode and the ground electrode precisely by simply bending the two legs in the direction of the center electrode. The gaps and angles described within the scope of this application are in particular measured before the ground electrode is bent for a fine adjustment of the spark plug gap, or the specifications for gaps and angles relate to a projection of the two legs into the leg plane perpendicular to the center axis. The first gap is measured between the end of the housing on the combustion chamber side and the leg plane. The ground electrode has a certain thickness in the leg plane; measurement is accordingly carried out in the center of the ground electrode. The second gap is measured from the center axis to the connection point. The connection point also has a certain thickness, and measurement is carried out in the center of the connection point for determining the second gap.

The further description herein disclose further refinements of the present invention.

In particular, it may be provided that in the leg plane, the circumference of the ground electrode is tapered toward the center axis. The temperature load of the ground electrode is greatest in particular in the leg plane. Consequently, a highly efficient reduction of the temperature absorption of the ground electrode is achieved with the aid of tapering in this area.

It may be provided that the ground electrode is formed as a wire whose diameter is tapered toward the center axis. In particular, the diameter of this wire is between 1 mm and 5 mm at the thinnest point, in particular between 1 mm and 3 mm. It may particularly be provided to use a wire having a thickness of 2 mm. Alternatively, it is provided that the ground electrode is formed as a metal sheet whose width measured perpendicularly to the center axis is tapered toward the center axis. The width of the metal sheet at the narrowest point is between 1 mm and 6 mm, in particular between 2 mm and 5 mm, in particular between 2.5 mm and 3.5 mm. It particularly may be provided to use a metal sheet having a thickness of 2.8 mm.

In addition, a metal sheet having a constant width or a wire having a constant thickness may also be used. In this case, the constant thickness or the constant width may lie in the previously described value ranges.

In addition, it may be provided that the circumference of the ground electrode is tapered toward the center axis by at least 3%, in particular at least 5%, in particular at least 7%. For example, a taper of 5% means that the ground electrode has a width of 5 mm and a thickness of 1 mm (the circumference is thus 12 mm) at one point, and a width of 4.7 mm with the same thickness at a point closer to the center axis. At the bending position between the two legs of the two-legged ground electrode, which may be situated directly above the center electrode, the width may again increase somewhat.

In a particular embodiment, it is provided that the two legs are at an angle of 20° to 179°, in particular 30° to 179°, in particular 30° to 170°, in particular 60° to 150°, and in particular may be approximately 90° to each other in the leg plane. These angular ranges ensure that the two connection points between the ground electrode and the housing do not lie directly opposite and that it is thus always possible to bend the ground electrode in the direction of the center electrode to adjust the spark plug gap.

In addition, individual or multiple apertures in any form may be provided in the ground electrode, in order in particular to be able to influence the gas flow in or out of the spark plug housing gas cavity.

In addition, it may be provided that the two legs of the ground electrode are manufactured together as one piece.

In addition, the ground electrode may include an extension between the housing and the leg plane extending in the direction of the center axis. This extension is welded to one end of the housing, and there is another weld connection to the legs of the ground electrode at the other end of the extension. Alternatively to this extension, the two ends of the ground electrode may be bent toward the housing.

The two legs of the ground electrode may be bent toward each other during the manufacturing process, and then the two ends are welded to the front side of the housing. The very short configuration of the ground electrode results in a reduction of heat input. Compared to a standard ground electrode, the peak temperature in the electrode according to the present invention is reduced by approximately 17%. The two-legged configuration and the double attachment to the front side of the housing increase the rigidity of the ground electrode according to the present invention. Bending of the ground electrode during operation caused by gas flows and temperature stresses is thus largely suppressed. Compared to a standard ground electrode, the rigidity thus increases by approximately 300%.

A low-alloy Ni alloy may be used as a ground electrode material. It is thus possible to establish the electrode gap between the center and ground electrode in a simple manner with the aid of plastic deformation of the electrode. Due to its ductility at room temperature, crack-free plastic deformation of the low-alloy Ni alloy is possible. A precious metal weld surface may be deposited on the ground electrode. In principle, highly alloyed Ni alloys (Cr component >10%) are also suitable for the ground electrode according to the present invention. However, adjustment of the electrode gap is then more complex, since these highly alloyed Ni alloys have lower ductility.

Adjustment of the electrode gap between the precious metal weld surface at the ground electrode and the center electrode is carried out by pressing on the legs of the ground electrode with a die. For this purpose, when welding the ground electrode to the housing, a larger electrode gap is advantageously selected, which is then reduced to the intended gap by pressing.

The two-legged ground electrode according to the present invention may be manufactured by bending of wire or blanking out of a sheet metal strip. Before welding, the ground electrode may be flat or preformed by any shape in or against the direction of the axis of symmetry of the spark plug. The two ends of the ground electrode are welded to the front side of the spark plug housing, resistance or laser welding processes being used. A precious metal wear surface is advantageously deposited on the legs opposite the center electrode in any form to increase service life. The attachment of the precious metal wear surface may be carried out with the aid of resistance or laser welding.

Five exemplary embodiments of the present invention are described in detail below with reference to the accompanying drawings.

DETAILED DESCRIPTION

Figure 1:
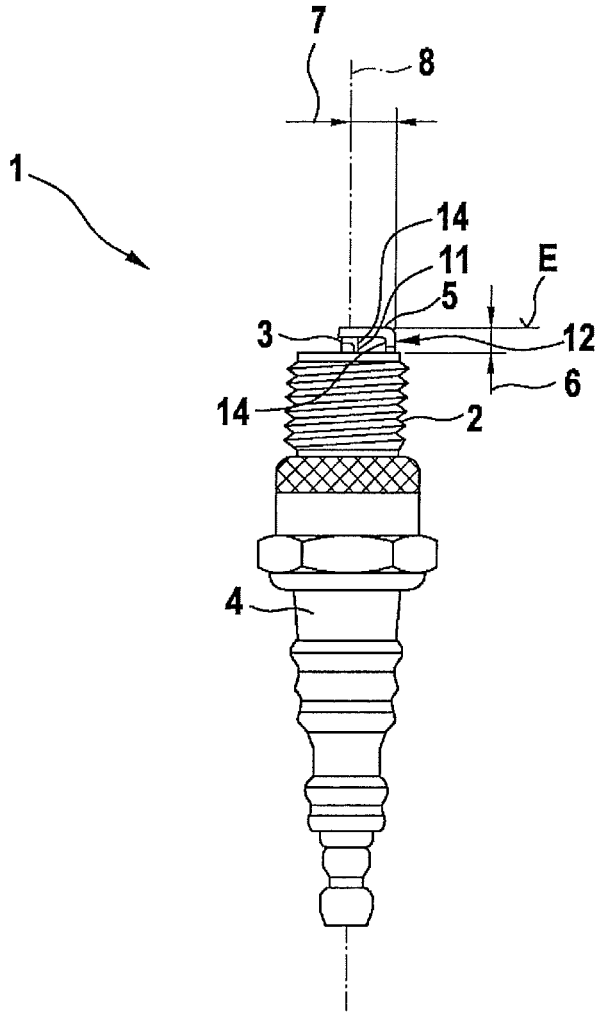
FIG. 1 shows a side view of a spark plug according to the present invention according to a first exemplary embodiment.
Figure 2:
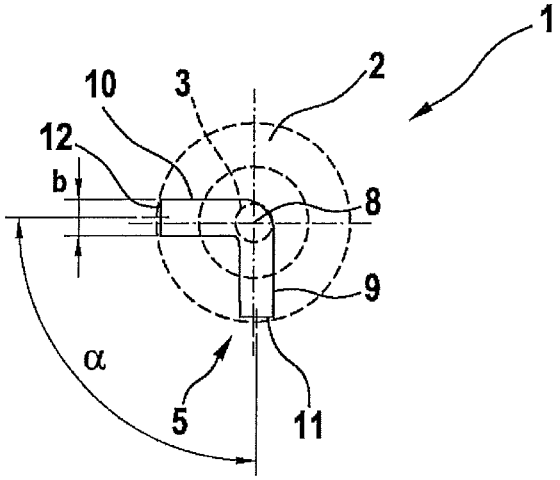
FIG. 2 shows a top view of a spark plug according to the present invention according to the first exemplary embodiment.

A first exemplary embodiment of a spark plug 1 according to the present invention is described with the aid of FIGS. 1 and 2.

Spark plug 1 includes a housing 2 as the ground contact to an internal combustion engine. Housing 2 has a thread for screwing spark plug 1 into the internal combustion engine. A center electrode 3 is situated in housing 2 along a center axis 8 of spark plug 1. An insulator 4 is located between center electrode 3 and housing 2.

A ground electrode 5 is situated on housing 2. This ground electrode 5 includes an extension 14, which extends parallel to center axis 8. From this extension 14, ground electrode 5 extends in so-called leg plane E opposite center electrode 3 and perpendicularly to center axis 8. Ground electrode 5 is connected at two connection points 11, 12 (see FIG. 2) to housing 2.

A first gap 6 is measured between the end of housing 2 on the combustion chamber side and leg plane E. As FIG. 1 shows, ground electrode 5 has a certain thickness in leg plane E; measurement is accordingly carried out in the center of ground electrode 5. A second gap 7 is measured from center axis 8 to connection point 11, 12 or up to extension 14. Extension 14 also has a certain thickness and is measured in the center of extension 14 for determining second gap 7.

The spark plug is constructed in such a way that first gap 6 is smaller than second gap 7. In particular, first gap 6 is at least 10% smaller than second gap 7, in particular at least 20% smaller. It is thus ensured that the length of ground electrode 5 and consequently also the surface of ground electrode 5 are kept as small as possible, so that heat transfer from the combustion chamber to ground electrode 5 is as low as possible.

FIG. 2 shows a top view on the combustion chamber side of spark plug 1 according to the first exemplary embodiment. As is apparent here, ground electrode 5 includes a first leg 9 and a second leg 10 in leg plane E. Ground electrode 5 is manufactured from a blanked metal sheet. The two legs 9, 10 have an angle $\alpha$ of 90° to each other. First leg 9 or an extension 14 on first leg 9 is connected to housing 2 with the aid of first weld connection (connection point) 11. Second leg 10 or an extension 14 on second leg 10 is connected to housing 2 with the aid of second weld connection 12 (connection point).

The two legs 9, 10 may converge directly over center electrode 3 or at center axis 8. The two legs 9, 10 in the first exemplary embodiment have a uniform width b, measured perpendicularly to center axis 8.

Figure 3:
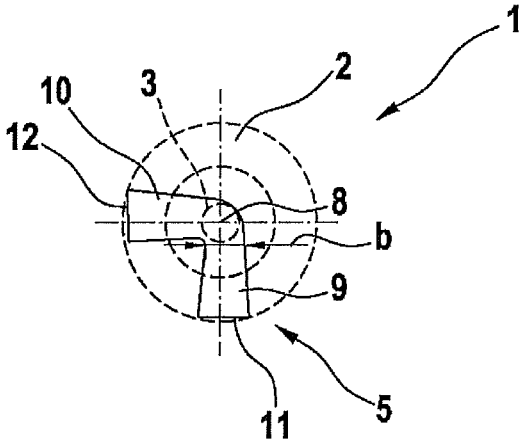
FIG. 3 shows a top view of a spark plug according to the present invention according to the second exemplary embodiment.

A second exemplary embodiment of spark plug 1 is described with the aid of FIG. 3. Identical or functionally identical components are provided with the same reference numerals in all exemplary embodiments.

As shown in FIG. 3, the width of the two legs 9, 10 decreases toward center axis 8 or toward center electrode 3. Smallest width b is indicated.

The two essential ideas of the present invention may be explained well with the aid of the first two exemplary embodiments. The essential idea of the present invention is that a surface of the ground electrode which is as small as possible results in temperature absorption by ground electrode 5 which is as low as possible, thereby avoiding oxidation of ground electrode 5 and thus extending service life. In the first exemplary embodiment, first gap 6 is formed relatively small in comparison to second gap 7. In the second exemplary embodiment, ground electrode 5, in particular, in the area of the greatest heat, namely, at center axis 8, is narrowed, as the result of which the surface of center electrode 3 also decreases. However, spark plug 1 according to the present invention must simultaneously enable adjustment of the electrode gap. An angled, two-legged ground electrode 5 is therefore used in both exemplary embodiments. This angled ground electrode 5 may be very easily bent in the direction of center axis 8.

Figure 4:
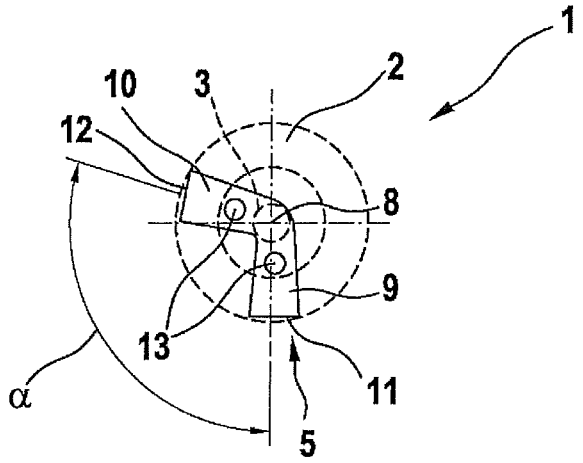
FIG. 4 shows a top view of a spark plug according to the present invention according to the third exemplary embodiment.

FIG. 4 shows a third exemplary embodiment of spark plug 1 according to the present invention. Identical or functionally identical components are provided with the same reference numerals in all exemplary embodiments. According to FIG. 4, in the third exemplary embodiment, angle $\alpha$ between the two legs 9, 10 is approximately 115°. In addition, in each of legs 9, 10, an aperture 13 is formed in the form of a cylindrical recess. This aperture 13 is used here to influence the gas flow into the spark plug housing gas cavity.

Figure 5:
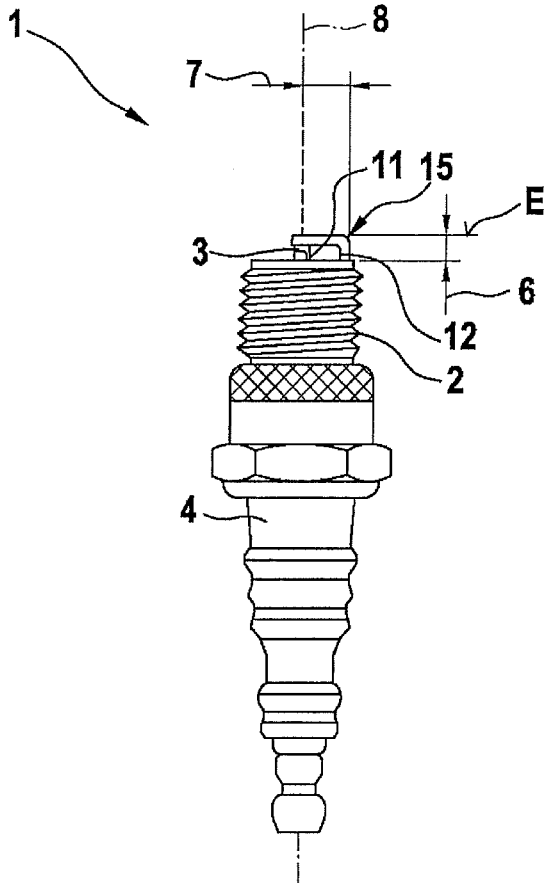
FIG. 5 shows a side view of a spark plug according to the present invention according to a fourth exemplary embodiment.

FIG. 5 shows a fourth exemplary embodiment of spark plug 1. Identical or functionally identical components are provided with the same reference numerals in all exemplary embodiments.

In the fourth exemplary embodiment, ground electrode 5 is completely configured as one piece, so that no extensions 14 have to be used as in the first exemplary embodiment. For this purpose, the ends of ground electrode 5 are bent at a bending position 15 by 90°. These ends are then welded to housing 2 at weld connection points 11, 12. First gap 6 is in turn selected to be smaller here than second gap 7, as in the first exemplary embodiment.

Figure 6:
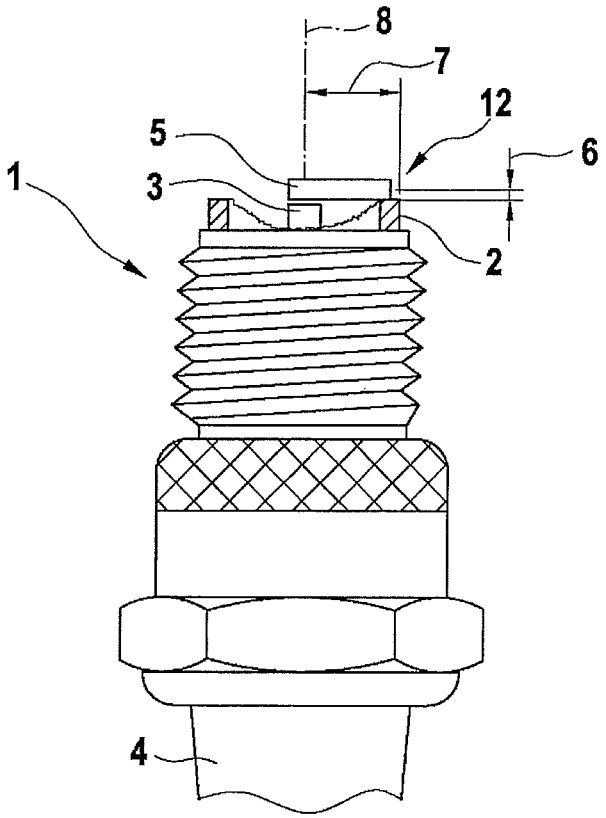
FIG. 6 shows a side view of a spark plug according to the present invention according to a fifth exemplary embodiment.

FIG. 6 shows a fifth exemplary embodiment of spark plug 1. Identical or functionally identical components are provided with the same reference numerals in all exemplary embodiments.

In FIG. 6, the end of spark plug 1 on the combustion chamber side is enlarged. In FIG. 6, housing 2 on the combustion chamber side extends beyond center electrode 3. The end of housing 2 on the combustion chamber side is depicted in FIG. 6 as broken open, so that center electrode 3 is visible. Ground electrode 5 is formed in the fifth exemplary embodiment as a flat component. Housing 2 on the combustion chamber side projects beyond center electrode 3, making it possible to weld this flat ground electrode 5 directly to the ends of housing 2. Second connection point 12 between housing 2 and ground electrode 5 is illustrated. First connection point 11 is not shown for the sake of clarity. First gap 6 reduces in this exemplary embodiment to half the thickness of ground electrode 5, measured parallel to center axis 8.

In all exemplary embodiments, it is possible to use the various forms of ground electrode 5 according to FIGS. 2 through 4.

What is claimed is:

1. A spark plug, comprising:

a housing, as a ground contact to an internal combustion engine;

a center electrode situated in the housing along a center axis of the spark plug;

an insulator between the center electrode and the housing; and a two-legged ground electrode, whose legs are located on the combustion chamber side of the center electrode and angled with respect to one another in a leg plane which is perpendicular to the center axis;

wherein each of the two ends of the ground electrode are connected to the housing by respectively one connection point, wherein a first gap between one end of the housing on the combustion chamber side and the leg plane is smaller than or equal to a second gap between one of the connection points and the center axis.

2. The spark plug of claim 1, wherein in the leg plane, the circumference of the ground electrode tapers toward the center axis.

3. The spark plug of claim 2, wherein the ground electrode is formed as a wire whose diameter is tapered toward the center axis, or the ground electrode is formed as a metal sheet whose width measured perpendicularly to the center axis is tapered toward the center axis.

4. The spark plug of claim 3, wherein the diameter of the wire at the thinnest point is between 1 mm and 5 mm, or the width of the metal sheet at the narrowest point is between 1 mm and 6 mm.

5. The spark plug of claim 1, wherein the circumference of the ground electrode is tapered toward the center axis by at least 3%.

6. The spark plug of claim 1, wherein the two legs in the leg plane are at an angle of 20° to 179° to each other.

7. The spark plug of claim 1, wherein there is at least one aperture in the ground electrode in the leg plane.

8. The spark plug of claim 1, wherein the two legs of the ground electrode are manufactured as one piece.

9. The spark plug of claim 1, wherein there is at least one extension extending in the direction of the center axis between the housing and the legs.

10. The spark plug of claim 1, wherein the two ends of the ground electrode are bent toward the housing.

11. The spark plug of claim 3, wherein the diameter of the wire at the thinnest point is between 1 mm and 3 mm, or the width of the metal sheet at the narrowest point is between 2 mm and 5 mm.

12. The spark plug of claim 1, wherein the circumference of the ground electrode is tapered toward the center axis by at least 5%.

13. The spark plug of claim 1, wherein the circumference of the ground electrode is tapered toward the center axis by at least 7%.

14. The spark plug of claim 1, wherein the two legs in the leg plane are at an angle of 30° to 179° to each other.

15. The spark plug of claim 1, wherein the two legs in the leg plane are at an angle of 30° to 170° to each other.

16. The spark plug of claim 1, wherein the two legs in the leg plane are at an angle of 60° to 150° to each other.

17. The spark plug of claim 1, wherein the circumference of the ground electrode tapers toward the center axis, and wherein the ground electrode is formed as a wire whose diameter is tapered toward the center axis in the leg plane.

18. The spark plug of claim 17, wherein the diameter of the wire at the thinnest point is between 1 mm and 3 mm.

19. The spark plug of claim 17, wherein the circumference of the ground electrode is tapered toward the center axis by at least 3%, and wherein the two legs in the leg plane are at an angle of 20° to 179° to each other.

20. The spark plug of claim 1, wherein the circumference of the ground electrode tapers toward the center axis, and wherein the ground electrode is formed as a metal sheet whose width measured perpendicularly to the center axis is tapered toward the center axis in the leg plane.

21. The spark plug of claim 1, wherein the width of the metal sheet at the narrowest point is between 2 mm and 5 mm.

22. The spark plug of claim 1, wherein the circumference of the ground electrode is tapered toward the center axis by at least 3%, and wherein the two legs in the leg plane are at an angle of 20° to 179° to each other.

23. The spark plug of claim 1, wherein there is at least one aperture in the ground electrode in the leg plane, and wherein the two legs of the ground electrode are manufactured as one piece.

24. The spark plug of claim 1, wherein there is at least one extension extending in the direction of the center axis between the housing and the legs, and wherein the two ends of the ground electrode are bent toward the housing.

25. The spark plug of claim 1, wherein the ground electrode is tapered toward the center axis in the leg plane.

26. A spark plug, comprising:

a housing, as a ground contact to an internal combustion engine;

a center electrode situated in the housing along a center axis of the spark plug;

an insulator between the center electrode and the housing; and a two-legged ground electrode, whose legs are located on the combustion chamber side of the center electrode and angled with respect to one another in a leg plane which is perpendicular to the center axis;

wherein each of the two ends of the ground electrode are connected to the housing by respectively one connection point, wherein a first gap between one end of the housing on the combustion chamber side and the leg plane is smaller than or equal to a second gap between one of the connection points and the center axis, and wherein the ground electrode is tapered toward the center axis.

* * * * *